US007011024B1

(12) United States Patent
Shih

(10) Patent No.: US 7,011,024 B1
(45) Date of Patent: Mar. 14, 2006

(54) STAMP DIE ASSEMBLY FOR A SELF-INKING STAMPING DEVICE

(76) Inventor: Shiny Shih, No. 31, Lane 349, Chungcheng S. Rd., Yungkang (TW)

( * ) Notice: Subject to any disclaimer, the term of this patent is extended or adjusted under 35 U.S.C. 154(b) by 0 days.

(21) Appl. No.: 10/937,788

(22) Filed: Sep. 10, 2004

(51) Int. Cl.
*B41K 1/42* (2006.01)

(52) U.S. Cl. ..... 101/334; 101/104; 101/109

(58) Field of Classification Search ..... 101/103, 101/104, 105, 109, 327, 333, 334
See application file for complete search history.

(56) References Cited

U.S. PATENT DOCUMENTS 5,152,223 A * 10/1992 Mairon ..... 101/334
5,623,875 A * 4/1997 Perets ..... 101/334
5,671,668 A * 9/1997 Shih ..... 101/104
5,709,145 A * 1/1998 Shih ..... 101/109
6,047,639 A * 4/2000 Shih ..... 101/333
6,931,990 B1 * 8/2005 Wei ..... 101/333

* cited by examiner

*Primary Examiner*—Ren Yan
(74) *Attorney, Agent, or Firm*—Hershkovitz & Associates; Abe Hershkovitz

(57) ABSTRACT

A stamp die assembly for a self-inking stamping device has a die bracket and a replaceable stamp die. The die bracket has a bracket block, a transverse recess, two clips and a fastener bracket. The replaceable stamp die is detachably mounted on the bracket and has a fastener and a plug. The fastener is formed on a back edge of the die block and extends through a slot of the fastener bracket in the die bracket. The plug is defined on a top end of the median tab and is mounted between the clips. The stamp die assembly is compact and lowers the cost of the self-inking stamp.

3 Claims, 7 Drawing Sheets

STAMP DIE ASSEMBLY FOR A SELF-INKING STAMPING DEVICE

BACKGROUND OF THE INVENTION

1. Field of the Invention

The present invention relates to a stamp die assembly for a stamp, and more particularly to a stamp die assembly for a self-inking stamping device.

2. Description of Related Art

There are several types of stamps available for consumers to choose and one of the types is a self-inking type. A self-inking stamping device allows a user to stamp papers or envelopes continuously.

With reference to FIGS. 7 and 8, a conventional self-inking stamping device comprises a hollow body (30), a stamp push (50), two springs (60) and a stamp die assembly (40).

The hollow body (30) has a front opening, a back, two sidewalls, two side slots (302), two semi-circular notches (301) and an ink pad (33). The side slots (302) are defined through the sidewalls and each has a top edge. The semi-circular notches (301) are defined respectively on the top edges of the side slots (302). The ink pad (33) is mounted inside the hollow body (30).

The stamp push (50) is mounted slidably on the hollow body (30) and has a front, a back, two side edges, a handle (52), two side tabs (51) and a slide rod (53). The front of the stamp push (50) faces the back of the hollow body (30). The handle (52) is formed on the back of the stamp push (50). The side tabs (51) extend from the front respectively on the side edges of the stamp push (50), correspond to and are mounted respectively and slidably on the sidewalls of the hollow body (30). The slide rod (53) is mounted slidably inside the side slots (302) through the side tabs (51) of the stamp push (50).

The springs (60) are mounted between the back of the hollow body (30) and the front of the stamp push (50).

The stamp die assembly (40) is mounted rotatably inside the hollow body (30) and has a die bracket (41) and a replaceable stamp die (42).

With further reference to FIG. 9, the die bracket (41) has a front, a back, a top edge, two sides, two positioning tabs (411), a transverse recess (412), two clips (413) and two overturning tabs (414). The positioning tabs (411) are formed on the back respectively on the sides of the die bracket (41) and each has a clearance between the positioning tab (411) and the back of the die bracket (41). The transverse recess (412) is defined on the top edge of the die bracket (41). The clips (413) are formed on the front and on opposite sides of the transverse recess (412) in the die bracket (41). The overturning tabs (414) are mounted respectively on the sides of the die bracket (41) and each has a shaft formed thereon. The shafts are rotatably mounted respectively inside the side slots.

The replaceable stamp die (42) is mounted detachably on the back of the die bracket (41) against the ink pad (33) and has a front surface, a patterned surface, two side edges, a plug (422) and two mounting tabs (421). The patterned surface is opposite to the front surface of the replaceable stamp die (42) and abuts against the ink pad (33). The plug (422) is formed on the front surface, is mounted between the clips (413) and has two side strips (423). The side strips (423) are formed respectively on opposite sides of the plug (422), and correspond to and engage respectively with the clips (413). The mounting tabs (421) are formed respectively on the side edges of the replaceable stamp die (42), and are mounted respectively inside the clearance between the corresponding one of the positioning tabs (413) and the back of the die bracket (41). When the replaceable stamp die (42) becomes worn, it can be replaced with a new one to maintain the stamping quality of the self-inking stamp.

To stamp a paper with the self-inking stamp, the stamp push (50) is pressed with a force toward the stamp die assembly (40) so the slide rod (53) pushes the die bracket (41) and causes the stamp die assembly (40) to rotate to 180 degrees. The patterned surface rotates to face the paper and stamps characters or images on the paper. When the urging force on the stamp push (50) is relaxed, the springs (60) press against the stamp push (50) with a resilient force and cause the stamp push (50) to go back to the original position. The stamp die assembly (40) rotates to 180 degrees and the patterned surface of the replaceable stamp die (42) is located against the ink pad (33) again.

However, each of the mounting tabs (421) of the replaceable stamp die (42) has a width about 3–5 millimeter (mm) and causes the size of the replaceable stamp die (42) to be excessively large. The die bracket (41), hollow body (30) and stamp push (50) have to be sized large enough to correspond to the replaceable stamp die (42) so as the self-inking stamping device is bulky and has a high cost.

To overcome the shortcomings, the present invention provides a stamp die assembly for a self-inking stamping device to mitigate or obviate the aforementioned problems.

SUMMARY OF THE INVENTION

The main objective of the invention is to provide a stamp die assembly for a self-inking stamping device that lowers the cost of the self-inking stamp.

A stamp die assembly for a self-inking stamping device in accordance with the present invention comprises a die bracket and a replaceable stamp die.

The replaceable stamp die is detachably mounted on the bracket and has a fastener and a plug.

Other objectives, advantages and novel features of the invention will become more apparent from the following detailed description when taken in conjunction with the accompanying drawings.

DETAILED DESCRIPTION OF PREFERRED EMBODIMENT

Figure 1:
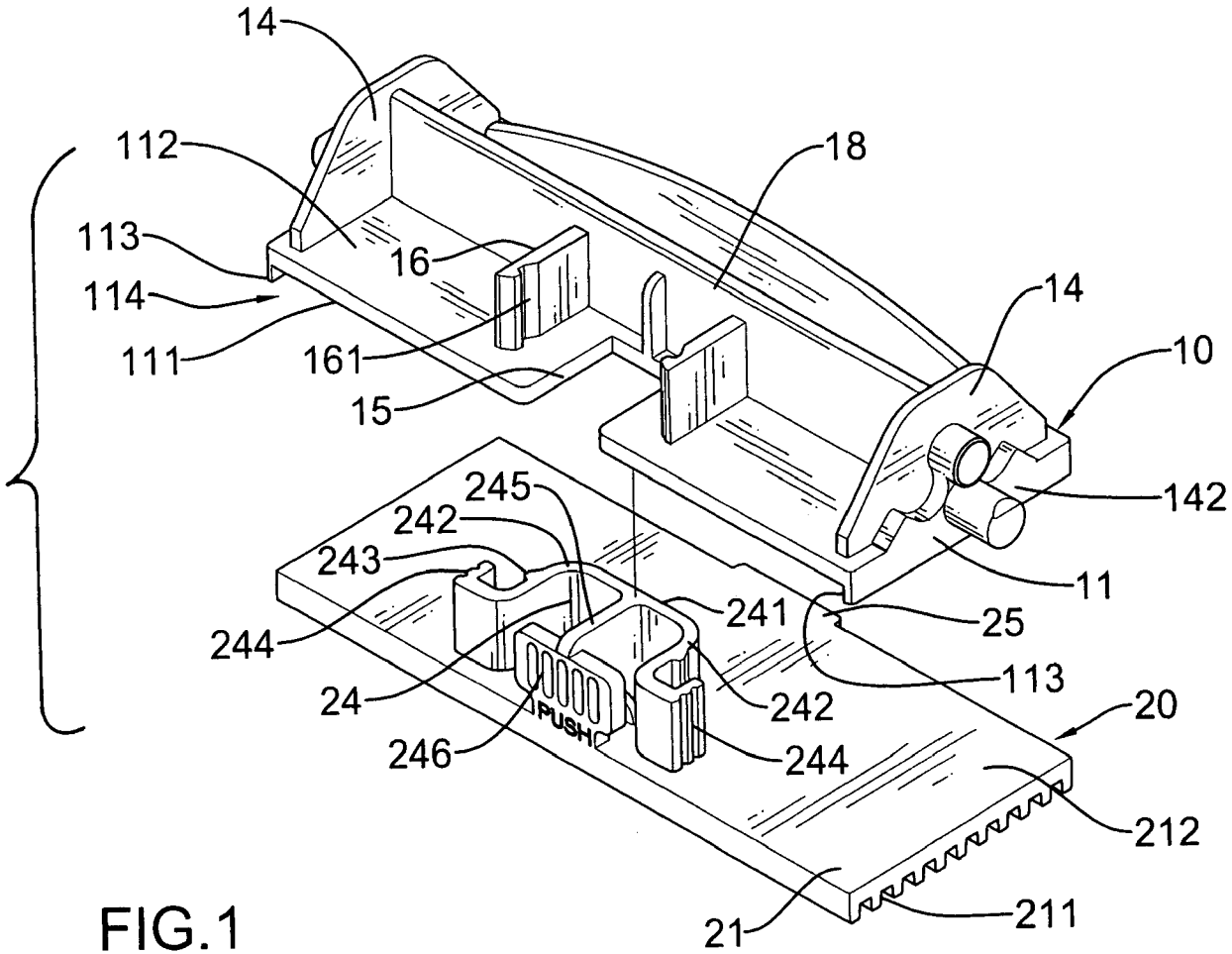
FIG. 1 is an exploded perspective view of a stamp die assembly for a self-inking stamping device in accordance with the present invention.
Figure 2:
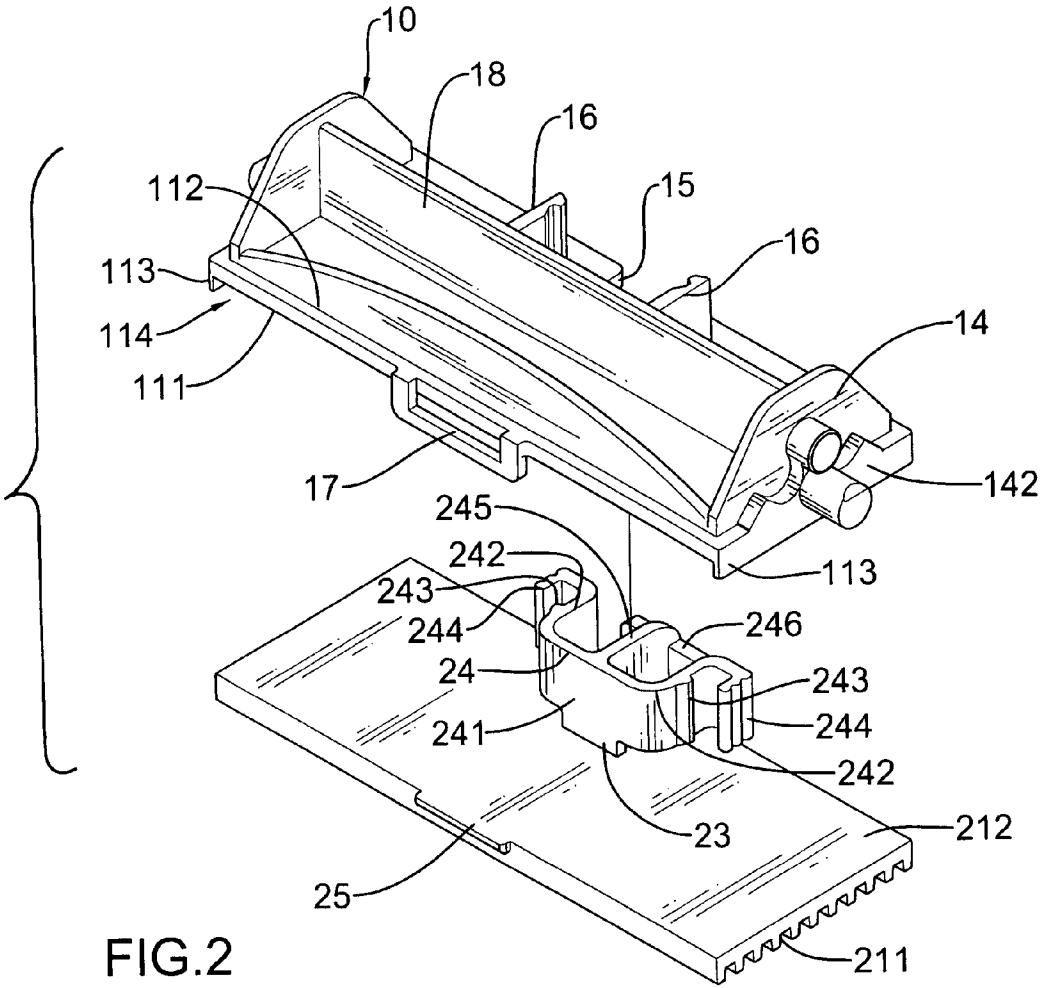
FIG. 2 is an exploded rear perspective view of the stamp die assembly for a self-inking stamping device in FIG. 1.

With reference to FIGS. 1 and 2, a stamp die assembly for a self-inking stamping device accordance with the present invention is used with a self-inking stamping device and comprises a die bracket (10) and a replaceable stamp die (20).

The die bracket (10) has a bracket block (11), two side transverse tabs (14), a transverse recess (15), a spine (18), two clips (16) and fastener bracket (17).

The bracket block (11) has a thickness, a front edge, a back edge, two side edges, a bottom surface (111), a top surface (112), two bottom side lips (113) and a bottom opening (114). The bottom side lips (113) are formed on the bottom surface, respectively on the side edges of the bracket block (11). The bottom opening (114) is defined on the bottom surface between the bottom side lips (113).

The side transverse tabs (14) are formed on the top surface (112) respectively on the side edges of the bracket block (11) and each has an outside and an overturning tab (142) formed on the outside.

The transverse recess (15) is defined through the bracket block (11) on the front edge. The spine (18) is formed on the top surface (112) of the bracket block (11) and between the side transverse tabs (14) behind the transverse recess (15). The clips (16) are defined on the top surface (112) of the bracket block (11), respectively on the opposite sides of the transverse recess (15) and each has a recess (161) defined on the clip (16) close to the transverse recess (15). The recesses (161) face each other.

The fastener bracket (17) is defined on the back edge of the bracket block (11) and has a slot defined through the fastener bracket (17).

Figure 4:
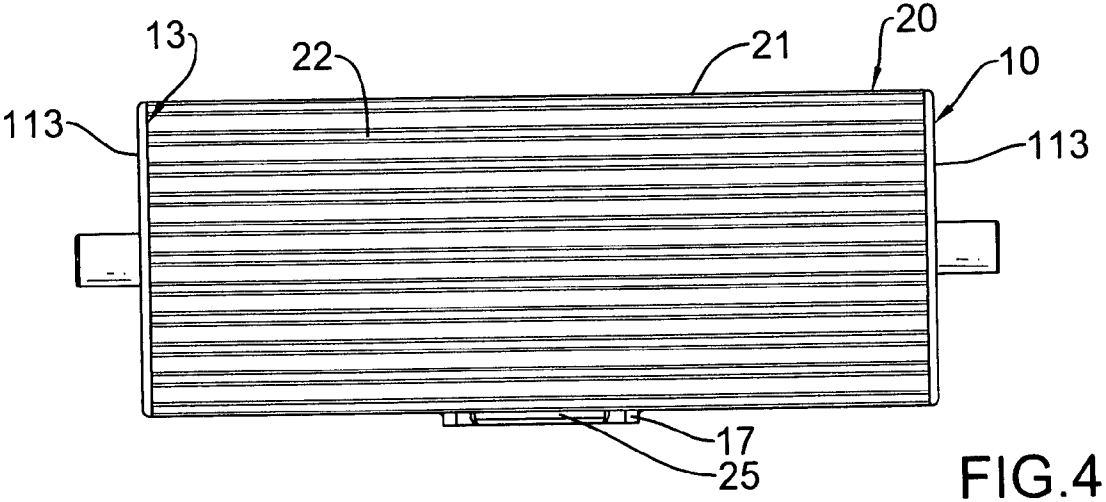
FIG. 4 is a bottom view of the stamp die assembly for a self-inking stamping device in FIG. 1.

With reference to FIGS. 1, 2 and 4, the replaceable stamp die (20) is made of rubber, is detachably mounted on the die bracket (10) and has a die block (21), a fastener (25), a median tab (23) and a resilient plug (24).

The die block (21) is mounted inside the bottom opening (114) of the bracket block (I 1) between the bottom side lips (113) and has a top surface (212), a patterned surface (211), a front edge and a back edge. The top surface (212) of the die block (21) faces against the bottom surface (111) of the bracket block (11). The patterned surface (21) is opposite to the die block (21) and has carved patterns or characters.

Figure 6:
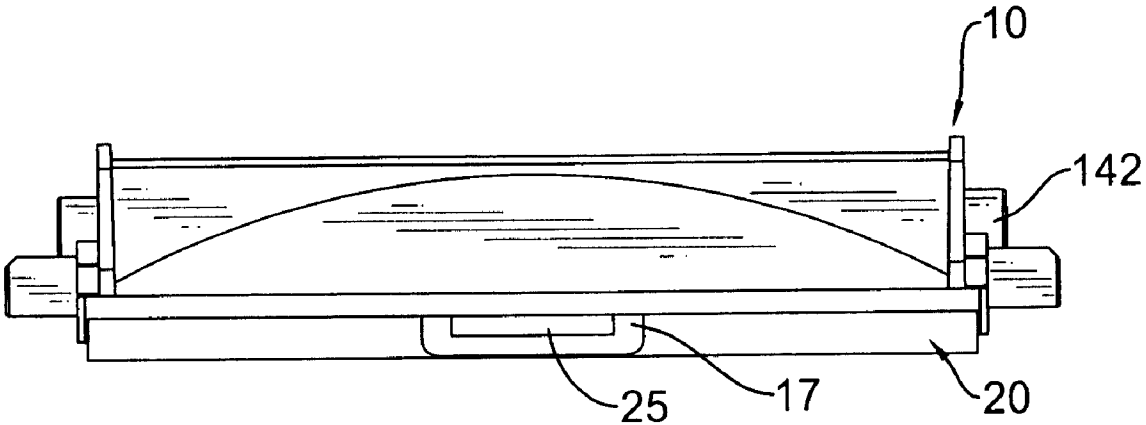
FIG. 6 is a back view of the stamp die assembly for a self-inking stamping device in FIG. 1.
Figure 7:
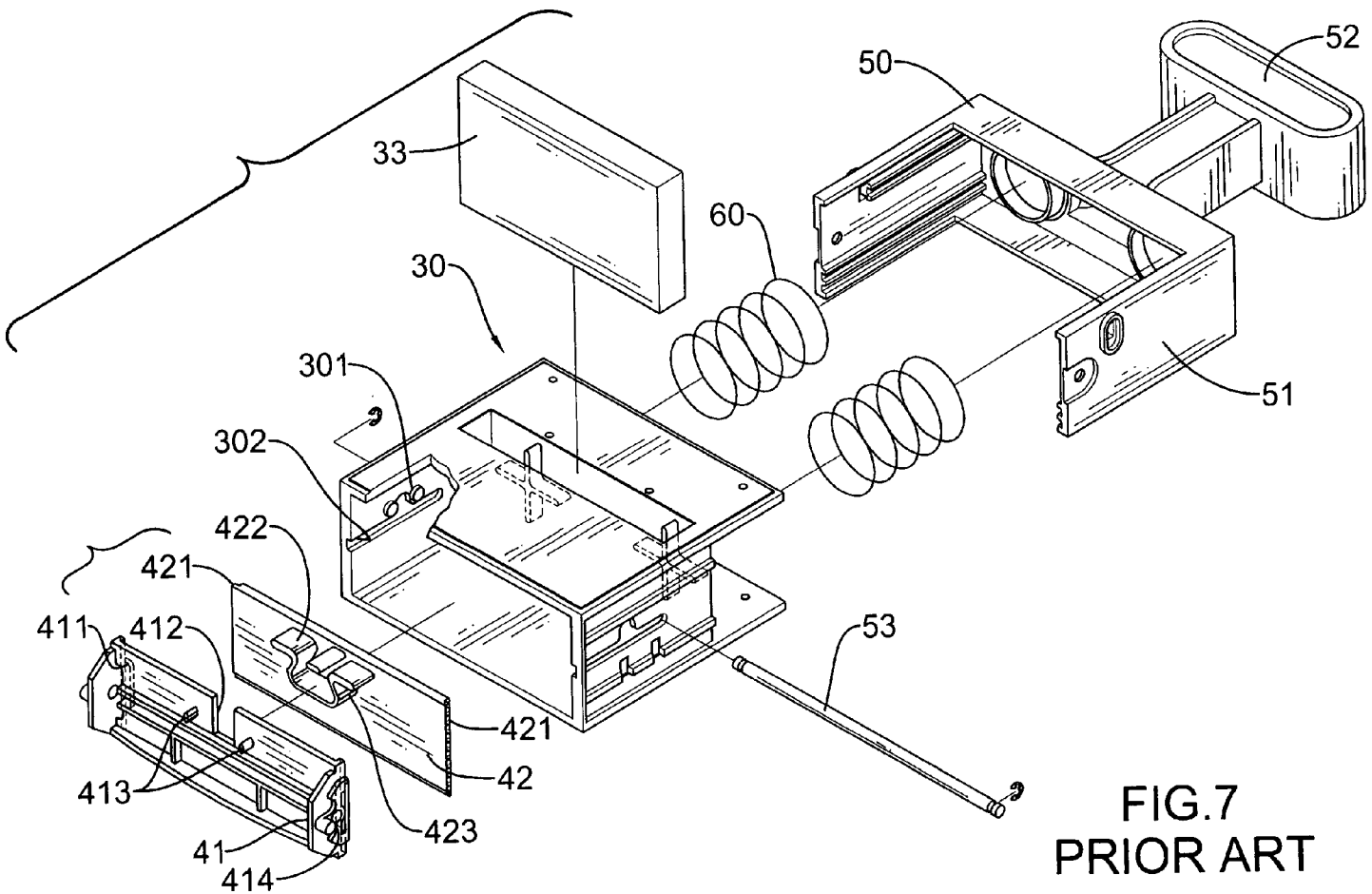
FIG.7 PRIOR ART
FIG. 7 is an exploded perspective view of a self-inking stamping device with a conventional stamp die assembly in accordance with the prior art.
Figure 8:
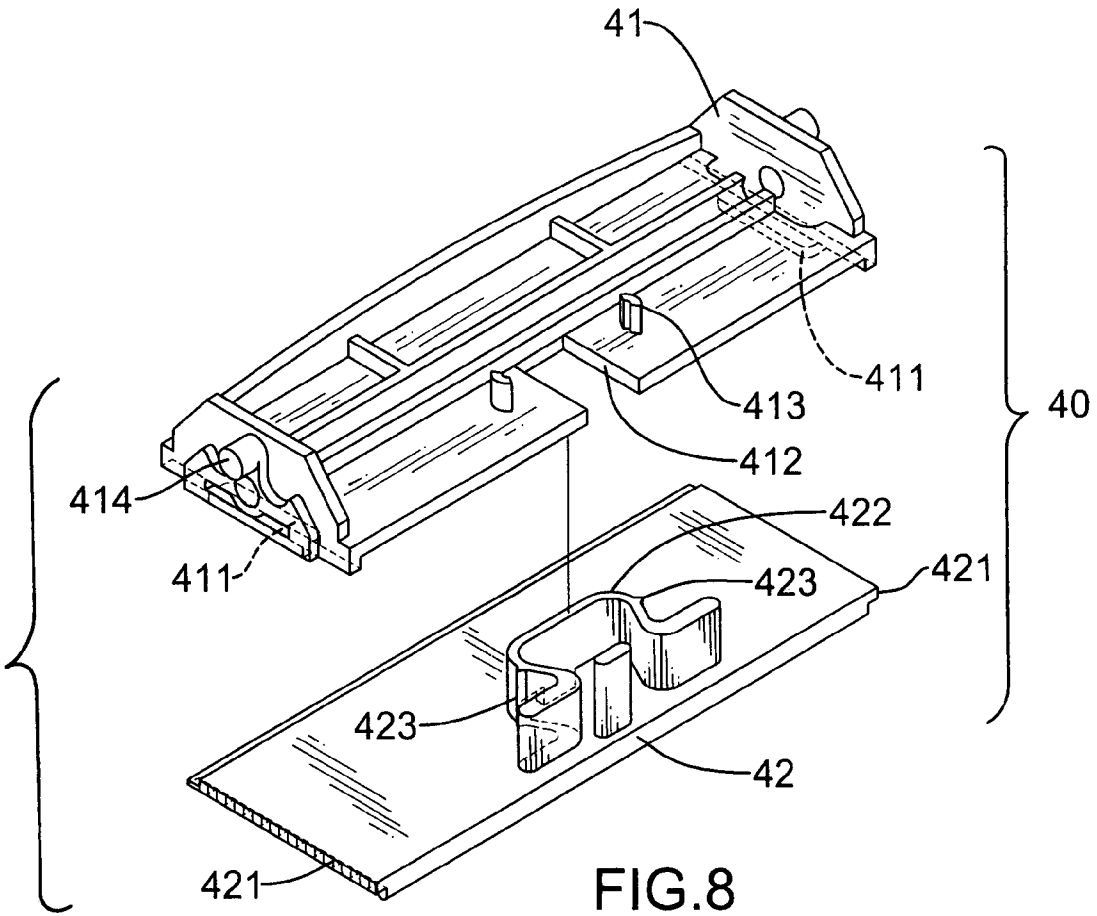
FIG.8 PRIOR ART
FIG. 8 is an exploded perspective view of the conventional stamp die assembly in FIG. 7.
Figure 9:
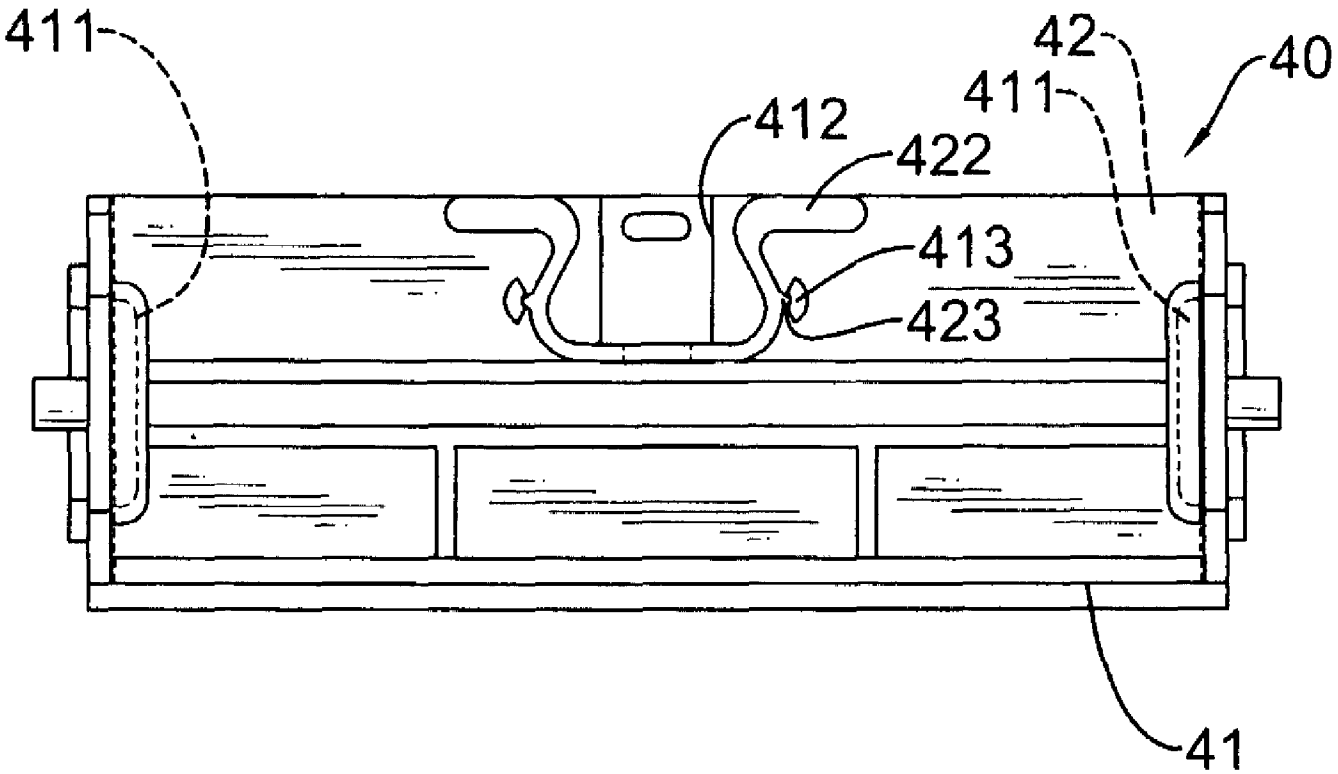
FIG.9 PRIOR ART
FIG. 9 is a front view of the conventional stamp die assembly in FIG. 7.

With reference to FIGS. 4 and 6, the fastener (25) is formed on the back edge of the die block (21) and extends through the slot of the fastener bracket (17) in the die bracket (10).

The median tab (23) is defined on the top surface (212) of the die block (21), is mounted inside the transverse recess (15) and has a thickness and a top end. The thickness of the median tab (23) is the same as that of the bracket block (11).

Figure 3:
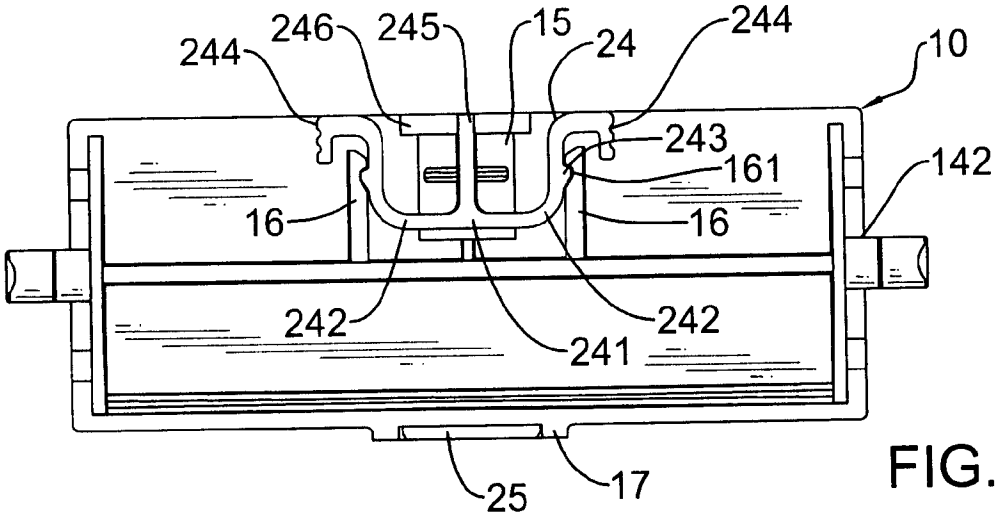
FIG. 3 is a top view of the stamp die assembly for a self-inking stamping device in FIG. 1.
Figure 5:
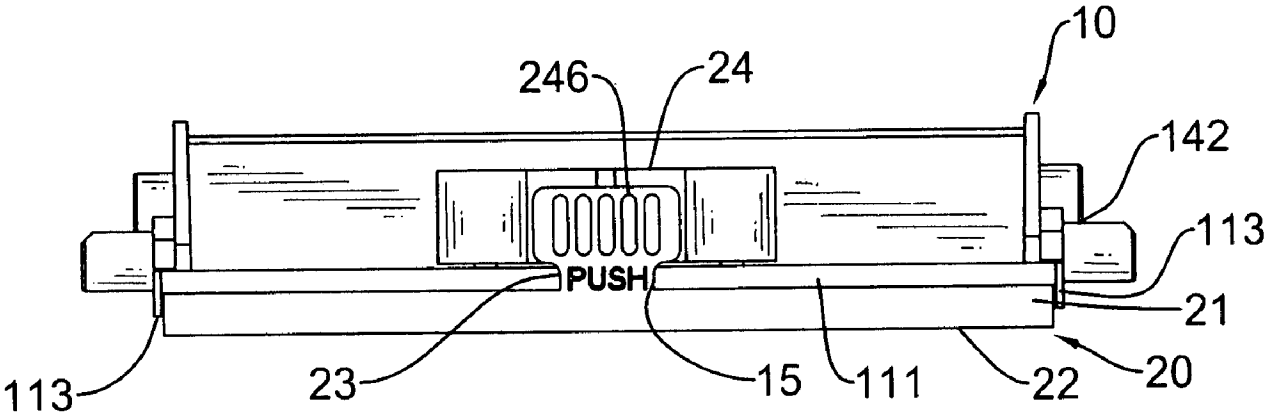
FIG. 5 is a front view of the stamp die assembly for a self-inking stamping device in FIG. 1.

With reference to FIGS. 1, 3 and 5, the plug (24) is defined on the top end of the median tab (23), and mounted between the clips (16). The plug (24) has a longitudinal tab (241), two side curved tabs (242), two side strips (243), two optional releasing tabs (244), a central spine (245) and an optional push (246). The longitudinal tab (241) is defined on the top end of the median tab (241) and has two sides. The side curved tabs (242) are formed respectively on the sides of the longitudinal tab (242) and urge respectively against the clips (16). Each side curved tab (242) has an outer end. The side strips (243) are defined respectively on the side curved tabs (242) and engage respectively inside the recesses (161) of the clips (16). The optional releasing tabs (244) are formed respectively on the outer ends of the side curved tabs (242). The central spine (245) is formed on the longitudinal tab (241) between the side curved tabs (242) and has a front end. The optional push (246) is formed on the front end of the central spine (245) and is located on the front edge of the die block (21).

The stamp die assembly for a self-inking stamping device in accordance with the present invention is mounted rotatably inside a hollow body and is driven by a stamp push of the self-inking stamping device to stamp papers or envelopes. As the operation of the self-inking stamping device is conventional and not the focus of the invention, it is described only briefly.

When carved patterns or characters on the replaceable stamp die (20) are worn, the replaceable stamp die (20) is taken off from the die bracket (10) by pressing the optional releasing tabs (244) toward each other to cause the side strips (243) to disengage respectively from the recesses (161) of the clips (16). Then a new replaceable stamp die (20) is mounted to the die bracket (10) whereafter stamping processes can be begun. The replaceable stamp die (20) is mounted to the die bracket (10) with the plug (24) and the fastener (25) without mounting tabs formed respectively on sides of the die block (21). A width of the replaceable stamp die (20) is reduced by about 6–10 millimeters (mm) relative to a conventional replaceable stamp die (20). Components of the self-inking stamping device are sized small to correspond to the stamp die assembly in accordance with the present invention and the cost of the self-inking stamping device is lowered. In addition, the optional releasing tabs (244) allow a user to easily take the replaceable stamp die (20) off from the die bracket (10) without strenuous effort.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A stamp die assembly for a self-inking stamping device comprising a die bracket having a bracket block having a thickness;

a front edge;

a back edge;

two side edges;

a bottom surface;

a top surface;

two bottom side lips formed on the bottom surface respectively on the side edge of the bracket block; and a bottom opening defined in the bottom surface and between the bottom side lips;

two side transverse tabs formed on the top surface respectively on the side edges of the bracket block and each having an outside and an overturning tab formed on the outside;

a transverse recess defined through the bracket block on the front edge;

a spine formed on the top surface of the bracket block and between the side transverse tabs behind the transverse recess;

two clips defined on the top surface of the bracket block respectively on the opposite sides of the transverse recess and each having a recess defined on the clip close to the transverse recess, wherein the recesses face each other; and a fastener bracket defined on the back edge of the bracket block and having a slot defined through the fastener bracket; and a replaceable stamp die mounted inside the bottom opening of the bracket block and between the bottom side lips and having a die block mounted inside the bottom opening of the bracket block between the bottom side lips and having a top surface facing the bottom surface of the bracket block;

a patterned surface opposite to the die block;

a front edge; and a back edge;

a fastener formed on the back edge of the die block and extending through the slot of the fastener bracket in the die bracket;

a medium tab defined on the top surface of the die block, mounted inside the transverse recess and having a thickness and a top end; and a resilient plug defined on the top end of the median tab, and mounted between the clips and having a longitudinal tab defined on the top end of the median tab and having two sides;

two side curved tabs formed respectively on the sides of the longitudinal tab, urging respectively against the clips and each having an outer end;

two side strips defined respectively on the side curved tabs and engaging respectively inside the recesses of the clips; and a central spine formed on the longitudinal tab between the side curved tabs and having a front end.

2. The stamp die assembly for a self-inking stamping device as claimed in claim 1, wherein the plug further comprises two releasing tabs formed respectively on the outer ends of the side curved tabs.

3. The stamp die assembly for a self-inking stamping device as claimed in claim 2, wherein the plug further comprises a push formed on the front end of the central spine and located on the front edge of the die block.

* * * * *